US007820033B2

(12) United States Patent
Eng et al.

(10) Patent No.: US 7,820,033 B2
(45) Date of Patent: Oct. 26, 2010

(54) METHOD FOR ADJUSTING YIELDS IN A LIGHT FEED FCC REACTOR

(75) Inventors: Curtis N. Eng, Houston, TX (US); Yonglin Yang, Katy, TX (US)

(73) Assignee: Kellogg Brown & Root LLC, Houston, TX (US)

( * ) Notice: Subject to any disclaimer, the term of this patent is extended or adjusted under 35 U.S.C. 154(b) by 783 days.

(21) Appl. No.: 11/741,838

(22) Filed: Apr. 30, 2007

(65) Prior Publication Data

US 2008/0264829 A1 Oct. 30, 2008

(51) Int. Cl.
*C10G 7/08* (2006.01)

(52) U.S. Cl. ..... 208/93; 208/73; 208/76; 208/347; 208/351; 208/354; 585/251; 585/324; 585/330; 585/651; 585/653; 585/802; 585/803; 585/809

(58) Field of Classification Search ..... 208/73, 208/76, 93, 347; 585/251, 324, 330, 651, 585/653, 802, 803, 809
See application file for complete search history.

(56) References Cited

U.S. PATENT DOCUMENTS 3,437,714 A * 4/1969 Newman ..... 585/650
4,215,231 A * 7/1980 Raymond ..... 585/251
4,997,545 A 3/1991 Krishna et al.
5,043,522 A 8/1991 Leyshon et al.
5,198,590 A 3/1993 Sofranko et al.
5,523,502 A 6/1996 Rubin
5,944,982 A 8/1999 Lomas
6,069,287 A 5/2000 Ladwig et al.
6,287,522 B1 9/2001 Lomas
6,307,117 B1 * 10/2001 Tsunoda et al. ..... 585/651
6,339,181 B1 1/2002 Chen et al.
6,538,169 B1 3/2003 Pittman et al.
6,576,805 B2 * 6/2003 Keady et al. ..... 585/802
6,977,321 B1 12/2005 Dath et al.
7,128,827 B2 10/2006 Tallman et al.

* cited by examiner

*Primary Examiner*—Prem C. Singh
(74) *Attorney, Agent, or Firm*—KBR IP Legal Dept.

(57) ABSTRACT

A process for increasing ethylene yield in a cracked hydrocarbon is provided. A hydrocarbon feed stream comprising at least 90% by weight of one or more $C_4$-$C_{10}$ hydrocarbons can be heated to provide an effluent stream comprising at least 10% by weight propylene. The effluent stream can be selectively separated to provide a first stream comprising heavy naphtha, light cycle oil, slurry oil, or any combination thereof and a second stream comprising one or more $C_4$-$C_{10}$ hydrocarbons. The second stream can be treated to remove oxygenates, acid gases, water, or any combination thereof to provide a third stream comprising the one or more $C_4$-$C_{10}$ hydrocarbons. The third stream can be selectively separated to provide a product stream comprising at least 30% by weight propylene. At least a portion of the product stream can be recycled to the hydrocarbon feed stream to increase ethylene yield in the effluent stream.

19 Claims, 2 Drawing Sheets

METHOD FOR ADJUSTING YIELDS IN A LIGHT FEED FCC REACTOR

CROSS REFERENCE TO RELATED APPLICATIONS

1. Field

The present embodiments relate generally to processes for adjusting the yield in a fluidized catalytic cracking ("FCC") reactor. In particular, embodiments of the present invention relate to a process for adjusting yields in a light feed FCC reactor.

2. Background

Olefins have long been desired as products from the petrochemical industry. Olefins such as ethylene, propylene, butenes and pentenes are useful for preparing a wide variety of end products such as polyethylene, polypropylene, other polymers, alcohols, vinyl chloride monomer, and other petrochemicals.

Ethylene is an organic compound that is produced in the largest quantities worldwide. It is typically produced by steam cracking, but it can also be produced in a FCC process. The largest source of petrochemical propylene on a worldwide basis is that produced as the primary by-product of ethylene manufacture by thermal cracking. In fact, ethylene plants charging liquid feedstocks typically produce about 10 to 30 weight percent propylene per ton of feed. Petroleum refining, predominantly from FCC, is the next largest supplier of worldwide propylene.

Hydrocarbon cracking involves the conversion of complex organic molecules into simpler molecules by breaking carbon-carbon bonds. End products of the cracking reaction depend on temperature and presence of catalysts in the reaction. The most basic types are thermal cracking and catalytic cracking. Thermal cracking includes steam pyrolytic cracking and delayed coking. Catalytic cracking includes fixed bed catalytic cracking and FCC.

Steam pyrolytic cracking has been carried out in radiant furnace reactors at elevated temperatures for short residence times while maintaining a low reactant partial pressure, relatively high mass velocity, and effecting a low pressure drop through the reaction zone. The hydrocarbon feed to the steam pyrolytic cracker can be in the liquid or vapor phase or can be a mixed liquid/vapor phase. The feed is generally pre-heated from an ambient temperature to an intermediate temperature before being introduced into the convection zone of a pyrolysis furnace. The pre-heated feed is further heated in the convection zone to a temperature below that at which significant reaction takes place. Steam is typically added to the feed at some point prior to the radiant reaction zone of the furnace. The steam functions to maintain low hydrocarbon partial pressure and to reduce coking in the radiant reaction zone. The feed is cracked at very high temperatures and the resulting products separated. To prevent the production of large amounts of undesirable by-products and severe coking, it is desirable to rapidly cool the effluent product gases issuing from the radiant zone of the pyrolysis furnace.

In a FCC process, feedstock can include heavy gas oil, treated fuel oil, and residue from the lube treatment plant. The presence of catalyst allows the cracking reaction to take place at a relatively low temperature of about 500° C. Cracking of lighter olefinic or paraffinic feeds usually require higher temperatures. The FCC process is endothermic when handling lighter feeds and a supplemental heat source must be used in the process, such as a fired heater or supplemental firing. A typical fluidized catalytic cracker can contain a reactor and a regenerator. The reactor in a FCC process is called a riser which is a pipe in which a hydrocarbon feed gas is intimately contacted with small catalyst particles to effect the conversion of the feed to more valuable products.

Cracking of a hydrocarbon feedstock can also be accomplished by contacting hydrocarbon feedstock in a riser of the FCC reactor with catalyst composed of finely divided particulate material. As the cracking reaction proceeds and as the catalyst, un-reacted feedstock, and products rise through the FCC reactor, substantial amounts of coke are deposited on the catalyst, reducing or eliminating its effectiveness in the reaction process. This coked catalyst therefore must be removed from the FCC reactor and must be regenerated in the regeneration zone of the FCC regenerator in order to maintain an effective conversion of reactant(s) to a desired product within the FCC. Regeneration of coked catalyst occurs at high temperatures in order to burn the coke from the catalyst. The re-generated catalyst is returned to the reactor for further catalytic cracking. Fluidization of the catalyst by various gas streams allows the transport of the catalyst between the reaction zone and the regeneration zone.

While a large number of processes in the petrochemical industry are directed to the production of olefins, in recent years, demand has increased for light olefinic gases while supply of suitable feedstock has diminished. Therefore, there is a need for processes capable of improved flexibility in producing various olefins from hydrocarbon feedstock.

A need exists, therefore, for a solution to the limitations discussed above.

BRIEF DESCRIPTION OF THE DRAWINGS

The detailed description will be better understood in conjunction with the accompanying drawings as follows.

Figure 1:
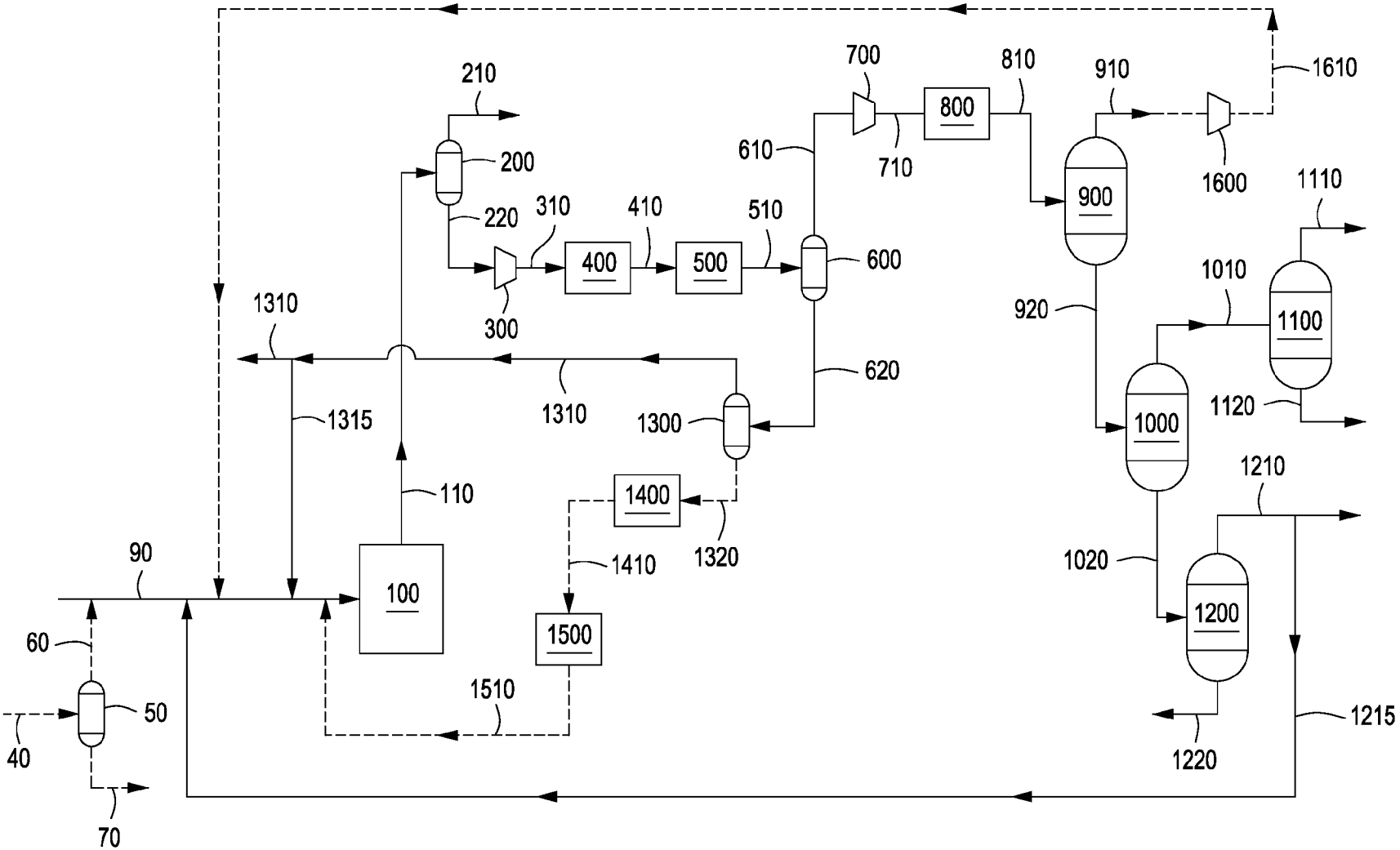
FIG. 1 depicts an illustrative process for increasing ethylene yield of a cracked or otherwise selectively altered hydrocarbon according to one or more embodiments.

The present embodiments are detailed below with reference to the listed Figures.

DETAILED DESCRIPTION OF THE EMBODIMENTS

Before explaining the present embodiments in detail, it is to be understood that the embodiments are not limited to the particular embodiments and that they can be practiced or carried out in various ways.

Processes having improved flexibility for producing various olefins from hydrocarbon feedstock are provided. The processes can provide increased production of ethylene from existing catalytic cracking units, existing thermal cracking units, or combinations thereof. In one or more embodiments, ethylene yield can be increased by suppressing propylene production. In at least one specific embodiment, at least part of a propylene containing product stream can be recycled to a hydrocarbon feed stream. Such recycle suppresses propylene production and increases ethylene yield in the effluent.

In one or more embodiments, a hydrocarbon feed stream having at least 90% $C_4$-$C_{10}$ hydrocarbons can be cracked or otherwise selectively altered to provide an effluent stream. The effluent stream can include at least 10% by weight propylene or at least 15 wt % propylene, or at least 20 wt % propylene or at least 25 wt % propylene or at least 27 wt % propylene in addition to other olefins and hydrocarbons. The effluent stream can be selectively separated to provide a first stream including heavy naphtha, light cycle oil, slurry oil, or any combination thereof and a second stream ("olefinic stream") including one or more olefins and other hydrocarbons. The second stream can be treated to remove oxygenates, acid gases, water, or any combination thereof to provide a third stream including the one or more olefins and other hydrocarbons. The third stream can be selectively separated to provide a product stream including propylene. In one or more embodiments, the product stream can include mixed $C_3$s including propylene. At least a portion of the product stream can be recycled to the hydrocarbon feed stream.

The term "heavy" as used herein refers to hydrocarbons having a carbon number greater than 12. The term "intermediate" as used herein refers to hydrocarbons having a carbon number generally between 4 and 8.

The term "naphtha" as used herein refers to a hydrocarbon mixture having a 10 percent point below 175° C. and a 95 percent point below 240° C. as determined by distillation in accordance with the standard method of ASTM D86. The term "heavy naphtha" as used herein refers to a naphtha fraction with a boiling range within the range of 166° C. to 211° C.

As used herein, the term "olefinic" in reference to a feed or stream refers to a light hydrocarbon mixture comprising at least 20 wt % olefins. The term "light" as used herein refers to hydrocarbons that have a carbon number less than 12.

With reference to the figures, FIG. 1 depicts an illustrative process for increasing the ethylene yield of a cracked or otherwise selectively altered hydrocarbon according to one or more embodiments described. As depicted in FIG. 1, a hydrocarbon feed stream 90 including at least 90 wt % $C_4$-$C_{10}$ hydrocarbons can be introduced into at least one cracker 100 where the hydrocarbon feed stream 90 is cracked or otherwise selectively altered to provide an effluent stream 110. The at least 90 wt % $C_4$-$C_{10}$ hydrocarbons can include mixed olefins or mixed paraffins or both.

In one or more embodiments, the effluent stream 110 can include propylene, ethylene, or any combination thereof. The effluent stream 110 can be fractionated or otherwise selectively separated in one or more fractionators 200 to provide a heavy naphtha stream ("first stream") 210 and an olefinic stream ("second stream") 220 including one or more $C_2$-$C_{10}$ olefins and $C_1$-$C_{10}$ paraffins. In one or more embodiments, the olefinic stream 220 can be compressed using one or more compressors 300 to provide a compressed stream 310 which can be treated in one or more treating units 400 to remove oxygenates, acid gases, water, or any combination thereof to provide a treated stream 410. The treated stream 410 can be dried in one or more drying units 500 to provide a dried stream ("third stream") 510 including the one or more $C_2$-$C_{10}$ olefins and paraffins. In one or more embodiments, the dried stream 510 can be selectively separated in one or more de-propanizers 600 to provide a stream 610 including $C_3$ and lighter and a stream 620 including $C_4$ and heavier. The heavier stream 620 can be selectively separated in a gasoline splitter 1300 producing an intermediate stream 1310 including $C_4$-$C_6$ hydrocarbons and a heavy stream 1320 including $C_7$ and higher hydrocarbons.

In one or more embodiments, at least a portion of the intermediate stream 1310 can be recycled to the cracker 100 as intermediate recycle stream 1315. For example, at least 55 wt % to 65 wt %, 65 wt % to 75 wt %, 75 wt % to 85 wt %, or 85 wt % to 95 wt % of the intermediate stream 1310 can be recycled to the cracker 100 in the intermediate recycle stream 1315. In one or more embodiments, about 10 wt % to 20 wt %, 20 wt % to 30 wt %, 30 wt % to 40 wt %, or 40 wt % to 50 wt % of the intermediate stream 1310 can be recycled to the cracker 100 in the intermediate recycle stream 1315. The intermediate stream 1310 exiting the one or more gasoline splitters 1300 can include $C_4$-$C_6$ olefins in the range of 20 to 80 wt % $C_4$-$C_6$ hydrocarbons. In one or more embodiments, the intermediate stream 1310 can include about 5 wt % to about 65 wt % $C_4$ olefins and/or $C_5$ olefins, or about 5 wt % to about 40 wt % $C_6$ olefins.

The stream 610 including $C_3$ and lighter, from the one or more de-propanizers 600, can be compressed in one or more compressors 700 to provide a compressed stream 710. The compressed stream 710 can be chilled in at least one chill train 800 producing a chilled stream 810. The chilled stream 810 can be selectively separated in one or more de-methanizers 900 to provide a tail gas stream 910 including methane and a light stream 920 including $C_2$ and $C_3$. The light stream 920 can be selectively separated in one or more de-ethanizers 1000 to provide a stream 1010 including $C_2$ and a stream 1020 including $C_3$. At least one C2 splitter 1100 can be used to selectively separate the stream 1010 including $C_2$ to provide an ethylene product stream 1110 and an ethane product stream 1120. One or more C3 splitters 1200 can be used to selectively separate the stream 1020 enriched in $C_3$ to provide a propylene product stream 1210 and a propane product stream 1220.

At least a portion of the propylene product stream 1210 can be recycled to the cracker 100 as propylene recycle stream 1215. Recycling at least a portion of the propylene product stream 1210 suppresses propylene production in the one or more crackers 100, thereby increasing the yield of ethylene in the effluent stream 110. In one or more embodiments, at least 10 vol % to 60 vol %; 20 vol % to 60 vol %; 30 vol % to 60 vol %; 40 vol % to 60 vol %; or 50 vol % to 60 vol % of the propylene product stream 1210 can be recycled to the one or more crackers 100 in the propylene recycle stream 1215. In one or more embodiments, at least 60 wt % to 100 wt %; 70 wt % to 100 wt %; 80 wt % to 100 wt %; or 90 wt % to 100 wt % of the propylene product stream 1210 can be recycled to the one or more crackers 100 in the propylene product recycle stream 1215. In one or more embodiments, recycling 20 wt % of the propylene product stream 1210 to the one or more crackers 100 can provide a relative increase in ethylene of about 10 wt % to about 12 wt %. The propylene product stream 1210 exiting the one or more C3 splitters 1200 can include about 90 wt % to about 95 wt % propylene or about 95 wt % to about 99.9 wt % propylene. In one or more embodiments, the propylene product stream 1210 can include as low as about 60 wt % propylene. In one or more embodiments, stream 1020 can be recycled in whole or in part to the reactor.

Considering the crackers 100 in more detail, each cracker 100 can be any system or apparatus suitable for selectively separating a hydrocarbon, including a steam pyrolytic cracker, a hydrocracker, a catalytic cracker, or a fluidized catalytic cracker. For example, the cracker 100 can be a fluidized catalytic cracker that includes a stacked reactor/regenerator, or a fluidized catalytic cracker that includes a riser/reactor, a disengager, a stripper, and a regenerator. In one or more embodiments, the cracker 100 can be a fluidized catalytic cracker that includes a dual riser/reactor, a disengager, a stripper, and a regenerator.

In one or more embodiments, at least two crackers 100 can operate in parallel or series. For example, the hydrocarbon feed stream 90 can be apportioned to at least two catalytic crackers 100, at least one fluid catalytic cracker 100 and at least one thermal cracker 100, or at least two pyrolytic crackers 100, arranged in parallel or series. In one or more embodiments, a dual riser/reactor fluidized catalytic cracker 100 can selectively separate the hydrocarbon feed stream 90, wherein at least a portion of the propylene product stream 1210 can be recycled in propylene product recycle stream 1215 to at least one riser of the dual riser/reactor fluidized catalytic cracker 100.

In one or more embodiments, the one or more catalytic crackers 100 and/or the one or more dual riser/reactor fluidized catalytic crackers 100 can employ any catalyst useful in catalytic cracking. Illustrative catalysts include, but are not limited to, Y-type zeolites, USY, REY, REUSY, faujasite, ZSM-5, and any combination thereof. In one or more embodiments, the catalyst to oil ratio can be about 5:1 to about 70:1; about 8:1 to about 25:1; or about 12:1 to about 18:1. In one or more embodiments, regenerated fluidized catalyst can contact the pre-heated hydrocarbon feed stream 90 at a temperature of about 425° C. to about 815° C.

In one or more embodiments, the hydrocarbon feed stream 90 can include about 5 wt % to about 95 wt % $C_4$, about 5 wt % to about 95 wt % $C_5$, about 5 wt % to about 95 wt % $C_6$, or about 5 wt % to about 95 wt % $C_7$ and heavier hydrocarbons. In or more embodiment, the hydrocarbon feed stream 90 can be introduced into one or more crackers 100 at temperatures ranging from a low of about 300° C., 400° C., or 500° C. to a high of about 600° C., 700° C., or 775° C. The hydrocarbon feed stream 90 can enter the cracker 100 at a temperature of about 25° C. to about 550° C.

In one or more embodiments, supplemental firing can be provided to the crackers 100. For example, the hydrocarbon feed stream 90 can be pre-heated using waste heat provided from downstream process fractionation. In one or more embodiments, the hydrocarbon feed stream 90 can be pre-heated to temperatures ranging from ambient conditions to a high of about 200° C. to about 500° C. In one or more embodiments, the hydrocarbon feed stream 90 can be pre-heated to a temperature of about 90° C. to about 370° C. The pre-heated hydrocarbon feed stream 90 can be vaporized before being introduced into cracker 100. In one or more embodiments, the pre-heated hydrocarbon feed stream 90 can be at least 10 vol % to 60 vol %; 20 vol % to 60 vol %; 30 vol % to 60 vol %; 40 vol % to 60 vol %; or 50 vol % to 60 vol % vaporized. In at least one specific embodiment, the pre-heated hydrocarbon feed stream 90 is at least 70 vol % to 100 vol %; 80 vol % to 100 vol %; or 90 vol % to 100 vol % vaporized.

The effluent stream 110 can exit the one or more crackers 100 at temperatures ranging from about 425° C. to about 645° C.; from about 450° C. to about 680° C., or from about 480° C. to about 595° C. The effluent stream 110 can include about 30 wt % to about 80 wt % $C_4$-$C_{10}$. In one or more embodiments, the effluent stream 110 can include about 5% to about 25 wt % $C_2$, about 5% to about 45 wt % $C_3$, about 5% to about 50 wt % $C_4$, or about 5 to about 50 wt % $C_5$ and heavier hydrocarbons.

Considering the fractionator 200, in more detail, the fractionator 200 can include any device suitable for removing heavy naphthas, light cycle oil, slurry oil, or any combination thereof from a hydrocarbon. In one or more embodiments, the one or more fractionators 200 can remove light naphtha, heavy naphtha, light cycle oil, slurry oil, or any combination thereof from the effluent stream 110 to recover the olefinic stream 220 including an olefinic fraction and the heavy naphtha stream 210 including a heavy naphtha fraction.

In one or more embodiments, the heavy naphtha stream 210 can include hydrocarbons with a carbon number between 7 and 12. For example, the heavy naphtha stream 210 can include about 5 wt % to about 50 wt % $C_7$, about 5 wt % to about 50 wt % $C_8$, about 1 wt % to about 25 wt % $C_9$, or about 1 wt % to about 15 wt % $C_{10}$ and heavier hydrocarbons.

The olefinic stream 220 can include about 30 wt % to about 95 wt % $C_4$-$C_{10}$. In one or more embodiments, the olefinic stream 220 can include about 5 wt % to about 95 wt % $C_4$, about 5 wt % to about 95 wt % $C_5$, about 5 wt % to about 95 wt % $C_6$, or about 5 wt % to about 95 wt % $C_7$ and heavier hydrocarbons. In one or more embodiments, the olefinic stream 220 can exit the fractionator 200 at pressures ranging from a low of about 0 kPa to about 20 kPa to a high of about 50 kPa.

Considering the compressor 300 in more detail, the compressor 300 can include any device suitable for compressing a gas, including reciprocating, rotary, axial flow, centrifugal, diagonal or mixed-flow, scroll, or diaphragm compressors. The compressed stream 310 can exit the one or more compressors 300 at pressures ranging from a low of about 500 kPa to a high a 3000 kPa. In one or more embodiments, the pressure of the compressed stream 310 can be about 100 kPa to about 3000 kPa or about 100 kPa to about 1000 kPa. In one or more embodiments, the acid composition of the compressed stream 310 fed to the one or more treating units 400 can range from a low of about 100 ppmv to a high of about 5 vol % total acid gas. In at least one specific embodiment, the compressed stream 310 can have a temperatures ranging from a low of about 5° C. to high of about 50° C.

Considering the treating unit 400 in more detail, the treating unit 400 can include any system or device suitable for removing oxygenates, acid gas, water, and any other known contaminants for downstream polymerization processes. In one or more embodiments, the treated stream 410 leaving the treating unit 400 can include less than about 500 ppmv $H_2S$, less than about 50 ppmv $H_2S$, or less than about 1 ppmv $H_2S$. In one or more embodiments, the treated stream 410 can include less than about 500 ppmv $CO_2$, less than about 100 ppmv $CO_2$, or less than about 1 ppmv $CO_2$.

Considering the drying unit 500 in more detail, the drying unit 500 can include any system or device suitable for removing water from a hydrocarbon, including systems using desiccants, solvents, or any combination thereof. The dried stream 510 exiting the drying unit 500 can include about 0.1 ppmv $H_2O$ to about 10 ppmv $H_2O$.

Each de-propanizer 600 can include any device suitable for selectively separating a hydrocarbon to provide a stream enriched in $C_3$ and lighter and a stream enriched in $C_4$ and higher. In one or more embodiments, the stream 610 enriched in $C_3$ and lighter exiting the one or more de-propanizers 600 can include about 99% wt or less $C_3$ and lighter, including hydrogen. The stream 610 enriched in $C_3$ and lighter can include about 5 wt % to about 40 wt % $C_2$, about 15 wt % to about 70 wt % $C_3$, and less than 10 wt % $H_2$. The stream 610 enriched in $C_3$ and lighter can exit the de-propanizer 600 at pressures ranging from a low of about 500 kPa to a high of about 1500 kPa. In one or more embodiments, the pressure of the stream 610 enriched in $C_3$ and lighter can be about 500 kPa to about 1500 kPa. The stream 620 enriched in $C_4$ and heavier exiting the one or more de-propanizers 600 can include about 99 wt % or less $C_4$-$C_{10}$. In one or more embodiments, the stream 620 enriched in $C_4$ and heavier can include about 40 wt % to about 80 wt % $C_4$, about 10 wt % to about 30 wt % $C_5$, about 5 wt % to about 15 wt % $C_6$, and less than about 15 wt % $C_7$ and heavier hydrocarbons.

The compressor 700 can include any device suitable for compressing a gas, including reciprocating, rotary, axial flow, centrifugal, diagonal or mixed-flow, scroll, or diaphragm compressors. The compressed stream 710 exiting the one or more compressors 700 can have discharge pressures ranging from a low of about 500 kPa to a high of about 3500 kPa. In one or more embodiments, the compressed stream 710 can exit the compressors 700 at pressures ranging from about 500 kPa to about 1500 kPa. The temperature of the compressed stream 710 can be within the range of about −20° C. to about 100° C.

The chill train 800 can include any system or device suitable for decreasing the temperature of a hydrocarbon. The chilled stream 810 can exit the one or more chill trains 800 at temperatures ranging from a low of about −100° C. to a high of about −5° C. In one or more embodiments, the chilled stream 810 can have a temperature about −20° C. to about −100° C.

The de-methanizer 900 can include any device suitable for selectively separating a hydrocarbon to provide a stream enriched in methane and a stream enriched in $C_2$ and/or $C_3$. For example, the tail gas stream 910 exiting the de-methanizer 900 can include 20 wt % to 50 wt % methane. In one or more embodiments, the tail gas stream 910 can include 35 wt % to 40 wt % methane. In one or more embodiments, the pressure of the tail gas stream 910 can range from a low of about 800 kPa to a high of about 3000 kPa. The light gas stream 920, exiting the one or more de-methanizers 900, can include about 15 mol % or less $C_2$-$C_3$. In one or more embodiments, the light gas stream 920 can include about 500 ppmv to about 2 mol % $C_2$ or about 100 ppmv to about 1 mol % $C_3$.

In one or more embodiments, the tail gas stream 910 can be recycled to the hydrocarbon feed stream 90. In one or more embodiments, the tail gas stream 910 exiting the de-methanizer 900 can be compressed in one or more compressors 1600 to provide a compressed tail gas stream 1610 an at least a portion of the compressed tail gas stream 1610 can be recycled to the cracker 100. For example, at least 15 vol % to 35 vol %; 20 vol % to 35 vol %; 25 vol % to 35 vol %; or 30 vol % to 35 vol % of the compressed tail gas stream 1610 can be recycled to the cracker 100.

Considering the compressor 1600 in more detail, the compressor 1600 can be any device suitable for compressing a gas, including reciprocating, rotary, axial flow, centrifugal, diagonal or mixed-flow, scroll, or diaphragm compressors. For example, the compressed tail gas stream 1610 exiting the one or more compressors 1600 can have a pressure ranging from a low of about 100 kPa to a high of about 2000 kPa. In one or more embodiments, the compressed tail gas stream 1610 exits the compressor 1600 at temperatures ranging from a low of about −5° C. to a high of about 100° C.

The de-ethanizer 1000 can be any device suitable for selectively separating a hydrocarbon to provide a stream enriched in $C_2$ and a stream enriched in $C_3$. In one or more embodiments, the de-ethanizer 1000 can provide a stream 1010 enriched in $C_2$ having 50 wt % to 99 wt % $C_2$. In one or more embodiments, the stream 1010 enriched in $C_2$ can include about 40 wt % to 50 wt % ethane or about 50 wt % to 60 wt % ethylene. The one or more de-ethanizers 1000 can provide a stream 1020 enriched in $C_3$ including about 99% or less $C_3$. In one or more embodiments, the stream 1020 enriched in $C_3$ can include about 5 wt % to about 25 wt % propane or about 75 wt % to about 95 wt % propylene.

The C2 splitter 1100 can be any device suitable for selectively separating a hydrocarbon enriched in $C_2$ to provide an ethylene product stream and an ethane product stream. In one or more embodiments, the ethylene product stream 1110 exiting the C2 splitter 1100 can include 50 wt % to 95 wt % ethylene. In one or more embodiments, the ethylene product stream 1110 can include at least 95 wt % ethylene. The ethane product stream 1120 exiting the C2 splitter 1100 can include about 95 wt % or less ethane. In one or more embodiments, the ethane product stream 1120 can include at least 85 wt % to 95 wt % ethane.

Considering the C3 splitter 1200 in more detail, the C3 splitter can be any device suitable for selectively separating a hydrocarbon enriched in $C_3$ to provide a propane product stream and a propylene product stream. In one or more embodiments, the C3 splitter 1200 can provide the propane product stream 1220 including about 99 wt % or less propane. In one or more embodiments, the propane product stream 1220 can include at least 85 wt % to 95 wt % propane.

The gasoline splitter 1300 can include any device suitable for selectively separating a hydrocarbon stream to provide a heavy stream including $C_7$ and higher and an intermediate stream including $C_4$-$C_6$ olefins. In one or more embodiments, the heavy stream 1320 provided by the one or more gasoline splitters 1300 can include about 95 wt % or less $C_4$-$C_6$ or about 95 wt % or less $C_7$ and heavier hydrocarbons. In one or more embodiments, the heavy stream 1320 can include at least 1 wt % $C_4$, at least 5 wt % $C_5$, at least 5 wt % $C_6$, at least 5 wt % $C_7$, and at least 5 wt % $C_8$ and heavier hydrocarbons.

The term "BTX" as used herein refers to a hydrocarbon mixture comprising at least benzene, toluene, and xylene, or any combination thereof. In one or more embodiments, the heavy stream including $C_7$ and higher hydrocarbons can be selectively separated to provide an aromatics stream enriched in BTX. At least a portion of the aromatics stream enriched in BTX can be recycled to the hydrocarbon feed stream 90. In one or more embodiments, the heavy stream 1320 from the gasoline splitter 1300 can be stabilized in one or more gasoline hydrotreaters 1400 to provide a treated gasoline stream 1410. The treated gasoline stream 1410 can be selectively separated in one or more BTX units 1500 for recovery of benzene, toluene, and/or xylene in an aromatics stream 1510. At least a portion of the aromatics stream 1510 enriched in BTX can be recycled to the one or more crackers 100.

Considering the gasoline hydrotreater 1400 in more detail, the gasoline hydrotreater 1400 can include any device suitable for stabilizing a gasoline, including treating with hydrogen to provide a stream with a reduced di-olefins content. In one or more embodiments, the treated gasoline stream 1410 exiting the gasoline hydrotreater 1400 can include at 5 wt % $C_6$ and heavier hydrocarbons. In one or more embodiments, the treated gasoline stream 1410 can include about 5 wt % to 50 wt % about 5 wt % to 50 wt % $C_6$, about 5 wt % to 50 wt % $C_7$, or about 5 wt % to 50 wt % $C_8$ and heavier hydrocarbons.

The BTX unit 1500 can include any system suitable for recovering an aromatics stream enriched in BTX from a hydrocarbon stream. In one or more embodiments, the aromatics stream 1510 enriched in BTX exiting the one or more BTX units 1500 can include 10 wt %, 20 wt %, 30 wt %, 40 wt %, or even 50 wt % BTX. All or a part of the aromatics stream 1510 enriched in BTX can be recycled to the cracker 100. For example, at least 10 wt %, 20 wt %, 30 wt %, or 40 wt % of the aromatics stream 1510 enriched in BTX can be recycled to the one or more crackers 100. In at least one specific embodiment, about 50 wt % or less of the aromatics stream 1510 enriched in BTX can be recycled to the cracker 100.

In one or more embodiments, the hydrocarbon feed stream comprising at least 90 wt % of one or more $C_4$-$C_{10}$ hydrocarbons is provided by pre-fractionating a hydrocarbon stream. In one or more embodiments, a hydrocarbon stream 40 can be introduced into one or more pre-fractionators 50 and selectively separated to provide a feed stream 60 having at least 90 wt % $C_4$-$C_{10}$ hydrocarbons. All or a portion of the feed stream 60 removed from the pre-fractionator 50 can be introduced to the one or more crackers 100. In one or more embodiments, the feed stream 60 can be introduced into the one or more crackers 100 via the hydrocarbon feed stream 90.

Considering the pre-fractionator 50 in more detail, the pre-fractionator can be any device suitable for selectively separating a hydrocarbon to provide a hydrocarbon stream having at least 90 wt % of one or more $C_4$-$C_{10}$ hydrocarbons. In one or more embodiments, the hydrocarbon stream 40, which can include C4 Raffinate 1, C4 Raffinate 2, TAME Raffinate, coker naphtha, cracker naphtha, and ethylene plant naphtha can be selectively separated in the one or more pre-fractionators 50 to provide the feed stream 60 including about 90 wt % or less $C_4$, about 90 wt % or less $C_5$, about 90 wt % or less $C_6$, 90 wt % or less $C_7$, or about 90 wt % or less $C_8$ and heavier olefins. The feed stream 60 can exit the pre-fractionator 50 at a temperature from a low of about 25° C. to a high of about 100° C. In one or more embodiments, 10 wt %, 20 wt %, 30 wt %, or 40 wt % of the feed stream 60 provided from the one or more pre-fractionators 50 can be introduced to the cracker 100. In one or more embodiments, 40 wt %, 50 wt %, 60 wt %, 70 wt %, 80 wt %, 90 wt %, or 100 wt % of the feed stream 60 can be introduced to the cracker 100.

Figure 2:
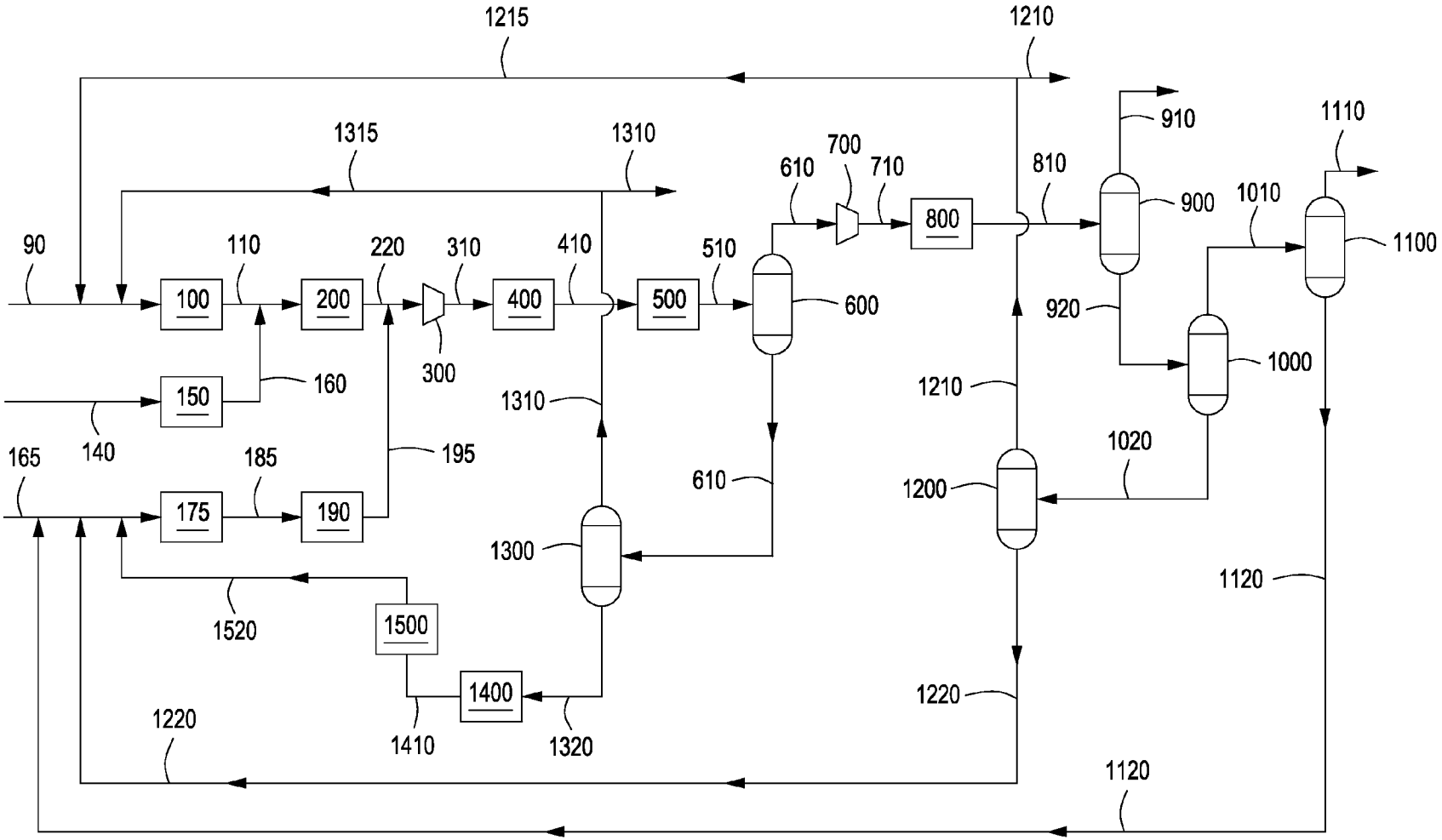
FIG. 2 depicts another illustrative process for increasing ethylene yield of a cracked or otherwise selectively altered hydrocarbon according to one or more embodiments.

FIG. 2 depicts another illustrative process for increasing the ethylene yield of a cracked or otherwise selectively altered hydrocarbon according to one or more embodiments. In one or more embodiments, each cracker 100 can be a fluidized catalytic cracker having a stacked reactor/regenerator. A hydrocarbon stream 140, including gas oil, full range gas oil, resid, or any combination thereof, can be introduced into at least one fluidized catalytic cracker 150 where the refinery hydrocarbon stream 140 is cracked or otherwise selectively altered to provide a refinery effluent stream 160 enriched in ethylene, propylene, or any combination thereof. The refinery effluent stream 160 can be combined with the cracked hydrocarbon effluent in the stream 110 and selectively separated in the one or more fractionators 200. A light alkane stream 165 can be cracked or otherwise selectively altered in one or more steam pyrolytic crackers 175 to provide a stream 185 enriched in ethylene, propylene, or combination thereof. The stream 185 can be quenched in the quench column 190 to provide a quenched effluent stream 195. The quenched effluent stream 195 can be combined with the olefinic stream 220 and compressed in one or more compressors 300.

At least a portion of ethane product stream 1120 can be recycled to the one or more steam pyrolytic crackers 175. In one or more embodiments, at least a portion of propane product stream 1220 can be recycled to the one or more steam pyrolytic crackers 175. In one or more embodiments, at least a portion of the ethane product stream 1120 and the propane product stream 1220 can be recycled to the one or more steam pyrolytic crackers 175. For example, any where from a low of about 60 vol %, 70 vol % or 80 vol % to a high of about 85 vol %, 90 vol %, 95 vol %, 96 vol %, 97 vol %, 98 vol %, 99 vol % or 100 vol % of the ethane product stream 1120 and/or from a low of about 60 vol %, 70 vol % or 80 vol % to a high of about 85 vol %, 90 vol %, 95 vol %, 96 vol %, 97 vol %, 98 vol %, 99 vol % or 100 vol % of the propane product stream 1220 can be recycled to the one or more steam pyrolytic crackers 175. In one or more embodiments, at least 15 vol % to 55 vol %; 25 vol % to 55 vol %; 35 vol % to 55 vol %; or 45 vol % to 55 vol % of either the ethane product stream 1120 or the propane product stream 1220 or both streams can be recycled to the one or more steam pyrolytic crackers 175. In at least one specific embodiment, at least 15 vol % to 45 vol %; 25 vol % to 45 vol %; or 35 vol % to 45 vol % of the ethane product stream 1120 can be recycled to the one or more steam pyrolytic crackers 175.

Considering the fluidized catalytic cracker 150 in more detail, the refinery hydrocarbon stream 140 cracked or otherwise selectively altered in the fluidized catalytic cracker 150 can include a hydrocarbon boiling within a temperature range of about 220° C. to about 645° C., about 285° C. to about 645° C., or about 650° C. to about 705° C. at pressures ranging from about 10 kPa to about 300 kPa. In one or more embodiments, the refinery hydrocarbon stream 140 can include gas oil, full range gas oil, resid, combination thereof, refinery recycle streams such as decanted oil, heavy catalytic cycle oil, and light catalytic cycle oil; or refinery recycle streams that are first processed, such as by hydrotreating, before use. In one or more embodiments, the refinery hydrocarbon stream 140 can be introduced into one or more fluidized catalytic crackers 150 at temperatures ranging from a low of about 100° C. to a high of about 400° C.

The refinery effluent stream 160 can exit the fluidized catalytic cracker 150 at temperatures ranging from a low of about 400° C. to a high of about 700° C. In one or more embodiments, the refinery effluent stream 160 can include about 40 wt % or less $C_4$-$C_{10}$. In one or more embodiments, the refinery effluent stream 160 can include about 15 wt % or less $C_2$, about 40 wt % or less $C_3$, about 40 wt % or less $C_4$, about 40 wt % or less $C_5$, or about 60 wt % or less $C_6$ and heavier hydrocarbons.

Considering the one or more steam pyrolytic crackers 175 in more detail, each steam pyrolytic cracker can be any cracker suitable for selectively separating a light alkane in the presence of steam to provide a stream enriched in ethylene, propylene, or any combination thereof. In one or more embodiments, the light alkane stream 165, which can include about 70 wt %, 80 wt %, or even 90 wt % $C_2$-$C_3$ alkanes, can be cracked or otherwise selectively altered in the one or more steam pyrolytic crackers 175 to provide the stream 185 having about 20 wt % to about 60 wt % $C_2H_4$ or about 1 wt % to about 30 wt % $C_3H_6$.

In one or more embodiments, the light alkane stream 165 can include ethane, propane, or any combination thereof. For example, the light alkane stream 165 can include 100 wt % $C_2H_6$ to about 100 wt % $C_3H_8$. The light alkane stream can also contain butanes, pentanes and hexanes. Before being introduced into the convection zone of the steam pyrolytic cracker 175, the light alkane stream 165 can be pre-heated by downstream fractionation, or any other process, from ambient temperatures to an intermediate temperature. For example, the light alkane stream 165 can be pre-heated from ambient temperatures of about 30° C. to intermediate temperatures of about 200° C.

Pre-heated or otherwise, the light alkane stream 165 can be introduced to the convection zone of a steam pyrolytic cracker 175 at temperatures ranging from a low of about 30° C. high of about 200° C. The light alkane stream can be heated in the convection zone of the steam pyrolytic cracker 175 to temperatures ranging from of low of about 30° C. to a high of about 700° C. In one or more embodiments, the light alkane stream can be partially vaporized in the convection zone. For example, at least 10 wt %, 20 wt %, 30 wt %, 40 wt %, or 50 wt % of the light alkane stream 165 can be vaporized in the convection zone of the steam pyrolytic cracker 175. In one or more embodiments, at least 55 wt %, 65 wt %, 75 wt %, 85 wt %, 95 wt %, or 100 wt % of the light alkane stream 165 can be vaporized in the convection zone of the steam pyrolytic cracker 175.

In one or more embodiments, the stream 185 can include about 60 wt % or less $C_2H_4$ or about 30 wt % or less $C_3H_6$. The stream 185 can exit the one or more steam pyrolytic crackers 175 at a temperature ranging from about 600° C. to about 1200° C. or ranging from about 750° C. to about 900° C.

Considering the quench column 190 in more detail, the quench column 190 can be any device suitable for reducing the temperature of a cracked hydrocarbon, thereby reducing or stopping the rate of hydrocarbon cracking. The quench column 190 can include packing media to provide surface area for the cracked hydrocarbon stream and a heat transfer medium to make thermal contact, such as rings, saddles, balls, irregular sheets, tubes, spirals, trays, and baffles. In one or more embodiments, the quenched effluent stream 195 can exit the quench column 190 at temperatures ranging from about 25° C. to about 100° C.

In one or more embodiments, a raffinate stream lean in aromatics can be recovered from the heavy stream including $C_7$ and higher hydrocarbons and at least a portion recycled to the steam pyrolytic cracker 175. For example, the heavy stream 1320 treated in gasoline hydrotreater 1400 can be processed in BTX unit 1500 to provide a raffinate stream 1520 lean in aromatics having less than 20 wt % BTX. In one or more embodiments, the aromatics content of the raffinate stream 1520 can be less than 10 wt % BTX. In one or more embodiments, at least 20 wt %, 30 wt %, 40 wt %, or 50 wt % of the raffinate stream 1520 lean in aromatics can be recycled to the steam pyrolytic cracker 175. In one or more embodiments, at least 70 wt %, 80 wt %, or 90 wt % of the raffinate stream 1520 lean in aromatics can be recycled to the steam pyrolytic cracker 175.

In one or more embodiments, 40 wt % to 50 wt % paraffins having 4 or more carbon atoms can be mixed with 5 wt % to 60 wt % olefins having 4 or more carbon atoms to provide a mixed stream. In one or more embodiments, 40 wt % to 95 wt % paraffins having 4 or more carbon atoms can be mixed with 5 wt % to 60 wt % olefins having 4 or more carbon atoms to provide a mixed stream. In one or more embodiments, the mixed stream can be passed to a reaction zone and contacted with a catalyst consisting essentially of a zeolite at conditions sufficient to provide a reaction product containing lighter olefins, including ethylene and propylene. In one or more embodiments, the reaction product can be selectively separated to provide a light olefinic stream comprising $C_2$-$C_3$ olefins. In one or more embodiments, at least a portion of the light olefinic stream can be combined with the hydrocarbon feed stream 90.

In one or more embodiments, the mixed stream can be passed to a reaction zone under conditions including a reaction temperature in the range of about 500° C. to about 700° C., a hydrocarbon partial pressure of about 1 to about 30 psia, and a paraffin hydrocarbon conversion per pass of less than 50%.

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

What is claimed is:

1. A process for increasing ethylene yield in a cracked hydrocarbon, comprising:

heating a hydrocarbon feed stream comprising at least 90% by weight of one or more $C_4$-$C_{10}$ hydrocarbons to provide an effluent stream comprising at least 5% by weight propylene;

selectively separating the effluent stream to provide a first stream comprising heavy naphtha, light cycle oil, slurry oil, or any combination thereof and a second stream comprising one or more $C_1$-$C_{10}$ hydrocarbons;

treating the second stream to remove oxygenates, acid gases, water, or any combination thereof to provide a third stream comprising the one or more $C_1$-$C_{10}$ hydrocarbons;

selectively separating the third stream to provide a product stream comprising at least 30% by weight propylene and a tail gas stream comprising at least 30% by weight methane;

recycling at least a portion of the tail gas stream to the hydrocarbon feed stream; and recycling at least a portion of the product stream to the hydrocarbon feed stream to increase ethylene yield in the effluent stream.

2. The process of claim 1, further comprising selectively separating the third stream to provide an intermediate stream comprising at least 30% by weight of one or more $C_4$-$C_6$ olefins and recycling at least a portion of the intermediate stream to the hydrocarbon feed stream.

3. The process of claim 1, further comprising:

selectively separating the third stream to provide an aromatics stream comprising at least 5% by weight benzene, toluene, xylene, or any combination thereof; and recycling at least a portion of the aromatics stream to the hydrocarbon feed stream.

4. The process of claim 1, wherein the hydrocarbon feed stream is a result of the selective separation of a hydrocarbon.

5. The process of claim 1, further comprising:

selectively separating a refinery hydrocarbon to provide a refinery effluent comprising at least 5% by weight propylene, wherein the refinery hydrocarbon comprises gas oil, full range gas oil, resid, or any combination thereof; and combining at least a portion of the refinery effluent with the effluent stream comprising at least 5% by weight propylene.

6. The process of claim 1, further comprising:

selectively separating a light alkane stream to provide an alkane effluent stream comprising at least 5% by weight propylene, wherein the light alkane stream comprises ethane, propane, butanes, pentanes, hexanes or any combination thereof;

quenching the alkane effluent stream to provide a quenched alkane effluent stream; and combining at least a portion of the quenched alkane effluent stream with the second stream.

7. The process of claim 5, further comprising:

selectively separating a light alkane stream to provide an alkane effluent stream comprising at least 5% by weight propylene, wherein the light alkane stream comprises ethane, propane, butanes, pentanes, hexanes or any combination thereof;

quenching the alkane effluent stream to provide a quenched alkane effluent stream; and combining at least a portion of the quenched alkane effluent stream with the second stream.

8. The process of claim 6, further comprising selectively separating the third stream to provide a light stream comprising at least 5% by weight ethane, propane, butanes, pentanes, hexanes or any combination thereof and recycling at least a portion of the light stream to the light alkane stream.

9. The process of claim 6, further comprising selectively separating the third stream to provide a raffinate stream comprising less than 10% by weight benzene, toluene, xylene, or any combination thereof and recycling at least a portion of the raffinate stream to the light alkane stream.

10. A process for increasing ethylene yield in a cracked hydrocarbon, comprising:

heating a hydrocarbon feed stream comprising at least 90% by weight of one or more $C_4$-$C_{10}$ hydrocarbons to provide an effluent stream comprising at least 5% by weight propylene;

selectively separating the effluent stream to provide a first stream comprising heavy naphtha, light cycle oil, slurry oil, or any combination thereof and a second stream comprising one or more $C_1$-$C_{10}$ hydrocarbons;

treating the second stream to remove oxygenates, acid gases, water, or any combination thereof to provide a third stream comprising one or more $C_2$-$C_{10}$ hydrocarbons;

selectively separating the third stream to provide a product stream comprising at least 30% by weight propylene and a tail gas stream comprising at least 30% by weight methane;

mixing 40% to 95% by weight paraffin hydrocarbons having 4 or more carbon atoms and 5% to 60% by weight olefins having 4 or more carbon atoms to provide a mixed stream;

passing said mixed stream to a reaction zone;

contacting said mixed stream with a catalyst consisting essentially of a zeolite at conditions sufficient to provide a reaction product comprising a lighter hydrocarbon than a hydrocarbon in said mixed stream;

selectively separating the reaction product to provide a light olefinic stream comprising $C_2$-$C_3$ olefins; and recycling at least a portion of the product stream, tail gas, and light olefinic stream to the hydrocarbon feed stream to increase ethylene yield in the effluent stream.

11. The process of claim 10, wherein the conditions sufficient to provide a reaction product comprising a lighter hydrocarbon than a hydrocarbon in said mixed stream include a reaction temperature in the range of 500° C. to 700° C., a hydrocarbon partial pressure in the range of 1 to 30 psia and a paraffin hydrocarbon conversion per pass of less than 50%.

12. The process of claim 10, further comprising:

selectively separating a refinery hydrocarbon to provide a refinery effluent comprising at least 5% by weight propylene, wherein the refinery hydrocarbon comprises gas oil, full range gas oil, resid, or any combination thereof; and combining at least a portion of the refinery effluent with the effluent stream comprising at least 5% by weight propylene.

13. The process of claim 12, further comprising selectively separating a light alkane stream to provide an alkane effluent stream comprising at least 5% by weight propylene, wherein the light alkane stream comprises ethane, propane, butanes, pentanes, hexanes or any combination thereof;

quenching the alkane effluent stream to provide a quenched alkane effluent stream; and combining at least a portion of the quenched alkane effluent stream with the second stream.

14. The process of claim 13, further comprising:

selectively separating the third stream to provide a light stream comprising at least 20% by weight ethane, propane, or any combination thereof and a raffinate stream comprising less than 5% by weight benzene, toluene, xylene, or any combination thereof; and recycling at least a portion of the light stream and the raffinate stream to the light alkane stream.

15. The process of claim 13, wherein the refinery hydrocarbon is cracked in a fluidized catalytic cracker.

16. The process of claim 13, wherein the light alkane stream is cracked in a steam pyrolytic cracker.

17. The process of claim 10, further comprising:

selectively separating a light alkane stream to provide an alkane effluent stream comprising at least 5% by weight propylene, wherein the light alkane stream comprises ethane, propane, butanes, pentanes, hexanes or any combination thereof;

quenching the alkane effluent stream to provide a quenched alkane effluent stream; and combining at least a portion of the quenched alkane effluent stream with the second stream.

18. The process of claim 10, further comprising:

selectively separating the third stream to further provide an intermediate stream comprising at least 30% by weight of one or more $C_4$-$C_6$ olefins, and an aromatics stream comprising at least 5% by weight benzene, toluene, xylene, or any combination thereof;

and further comprising recycling at least a portion of the tail gas, intermediate, and aromatics stream to the hydrocarbon feed stream.

19. A process for increasing ethylene yield in a cracked hydrocarbon, comprising:

heating a hydrocarbon feed stream comprising at least 90% by weight of one or more $C_4$ $C_{10}$ hydrocarbons to provide an effluent stream comprising at least 20% by weight propylene, wherein the hydrocarbon feed stream is provided by selectively separating a hydrocarbon comprising methane and propylene;

selectively separating the effluent stream to provide a first stream comprising heavy naphtha, light cycle oil, slurry oil, or any combination thereof and a second stream comprising one or more $C_1$-$C_{10}$ hydrocarbons;

treating the second stream to remove oxygenates, acid gases, water, or any combination thereof to provide a third stream comprising one or more $C_4$-$C_{10}$ olefins;

selectively separating the third stream to provide a product stream comprising at least 30% by weight propylene and a tail gas stream comprising at least 30% by weight methane;

mixing 40% to 95% by weight paraffin hydrocarbons having 4 or more carbon atoms and 5% to 60% by weight olefins having 4 or more carbon atoms to provide a mixed stream;

passing said mixed stream to a reaction zone;

contacting said mixture with a catalyst consisting essentially of a zeolite at conditions sufficient to provide a reaction product comprising a lighter hydrocarbon than the hydrocarbons in said mixture, said conditions including a reaction temperature in the range of 500° C. to 700° C., a hydrocarbon partial pressure in the range of 1 to 30 psia and a paraffin hydrocarbon conversion per pass of less than 50%;

selectively separating the reaction product to provide a light olefinic stream comprising C2-C3 olefins; and recycling at least a portion of the tail gas, product stream, and light olefinic stream to the hydrocarbon feed stream to increase ethylene yield in the effluent stream.

* * * * *